US012454391B2

(12) United States Patent
Plourde et al.

(10) Patent No.: US 12,454,391 B2
(45) Date of Patent: Oct. 28, 2025

(54) FLEXIBLE RECLOSABLE ENCLOSURE WITH FLAP

(71) Applicant: Illinois Tool Works Inc., Glenview, IL (US)

(72) Inventors: Eric P. Plourde, Frankfort, IL (US); Lars G. Wihlborg, Carol Stream, IL (US)

(73) Assignee: Illinois Tool Works Inc., Glenview, IL (US)

( * ) Notice: Subject to any disclaimer, the term of this patent is extended or adjusted under 35 U.S.C. 154(b) by 176 days.

(21) Appl. No.: 18/358,631

(22) Filed: Jul. 25, 2023

(65) Prior Publication Data

US 2024/0051713 A1 Feb. 15, 2024

Related U.S. Application Data

(60) Provisional application No. 63/371,141, filed on Aug. 11, 2022.

(51) Int. Cl.
*B65D 33/25* (2006.01)

(52) U.S. Cl.
CPC ..... *B65D 33/2583* (2013.01); *B65D 33/2585* (2020.05); *B65D 2215/08* (2013.01)

(58) Field of Classification Search
CPC ..... B65D 33/2583; B65D 33/2585; B65D 2215/08
USPC ..... 383/5, 200–211, 61.2, 63, 66
See application file for complete search history.

(56) References Cited

U.S. PATENT DOCUMENTS 5,954,433 A * 9/1999 Yeager ..... B65D 33/2533 383/203
6,149,302 A 11/2000 Taheri
7,476,030 B1 * 1/2009 Kuge ..... B65D 33/2533 383/203

(Continued)

FOREIGN PATENT DOCUMENTS

DE 102011053275 A1 * 3/2013 ..... A24F 23/02
EP 1683736 A2 * 7/2006 ..... B31B 70/00

(Continued)

OTHER PUBLICATIONS

International Search Report received for related PCT App. No. PCT/US2023/071038 mailed Nov. 23, 2023 (11 pages).

(Continued)

*Primary Examiner* — Jes F Pascua
(74) *Attorney, Agent, or Firm* — Christopher R. Carroll; The Small Patent Law Group LLC

(57) ABSTRACT

A reclosable enclosure includes a body having a front panel and a back panel secured to each other and forming a cavity therebetween to store contents. The body includes a flap that extends from a top end of the body. The reclosable enclosure includes a zipper assembly coupled to an interior surface of at least the front panel. The zipper assembly includes a first profile strip and a second profile strip that form a reclosable zipper to selectively close the cavity. The flap blocks access to the reclosable zipper and is sealed to at least one of the front panel or the second profile strip in an intact state of the flap. The flap defines one or more lines of weakness to permit irreparable separation of a sub-flap from a remainder of the flap to access the reclosable zipper.

20 Claims, 7 Drawing Sheets

(56) References Cited

U.S. PATENT DOCUMENTS

| | | | | |
|---|---|---|---|---|
| 7,481,580 | B2 * | 1/2009 | Schreiter | B65D 33/2533 383/203 |
| 2007/0116388 | A1 * | 5/2007 | Kuge | B65D 33/2583 383/203 |
| 2008/0152264 | A1 | 6/2008 | Pokusa et al. | |
| 2009/0152139 | A1 * | 6/2009 | Roesink | A24F 23/02 493/213 |
| 2015/0336713 | A1 * | 11/2015 | Gum | B65D 33/2508 383/203 |
| 2020/0299047 | A1 | 9/2020 | Perea-Ochoa et al. | |

FOREIGN PATENT DOCUMENTS

| | | | | |
|---|---|---|---|---|
| WO | WO-0002782 | A2 * | 1/2000 | B65D 31/08 |
| WO | 2008048661 | A2 | 4/2008 | |

OTHER PUBLICATIONS

International Preliminary Report on Patentability received for related PCT App. No. PCT/US2023/071038 mailed Feb. 20, 2025 (8 pages).

* cited by examiner

FLEXIBLE RECLOSABLE ENCLOSURE WITH FLAP

CROSS-REFERENCE TO RELATED APPLICATIONS

This application is a non-provisional conversion of, and claims priority to, U.S. Provisional Patent Application No. 63/371,141, which was filed on Aug. 11, 2022, and the entire disclosure of which is incorporated herein by reference.

FIELD

The subject matter of the present application relates to flexible, reclosable enclosures, such as flexible, front-opening packages.

BACKGROUND

Traditional packaging in food and beverage, personal care, and household care industries includes a main body formed of a rigid bottle or semi-rigid tube, and a rigid fitment or cap to selectively open and close the main body. Some packages have transitioned to flexible pouches for the main body, although many flexible packages continue to use rigid fitments attached to the pouch. There is a need within these industries to complete the transition to fully flexible packaging, without incorporating rigid or semi-rigid components.

Flexible enclosures (e.g., pouches, packages, bags, containers, etc.) can hold a variety of material. Some flexible enclosures have zipper assemblies that can repeatedly mesh and decouple from each other to selectively close and open the flexible enclosures. A subset of these reclosable enclosures include a tearable tape strip that covers and seals the zipper assembly from the external environment before the enclosure is opened by a user. For example, the zipper assembly may be secured along an interior of a front panel of the enclosure, and the zipper assembly can be accessed by pulling on the tearable tape strip which tears the front panel and provides an access slot through the front panel. A user can reach into access slot and pull apart the zipper assembly to access the product contents contained within the enclosure. When the tearable tape strip is intact, such that the front panel is untorn, the user is assured that the contents of the enclosure have not been tampered with and that the zipper assembly is sealed against exposure to dirt, dust, and other debris. It can be difficult and relatively costly to manufacture these types of enclosures with tearable tape strips along the front panels that seal access to the zipper assemblies.

An alternative design of a reclosable flexible enclosure may omit the tearable tape strip entirely and form the enclosure without sealing the zipper assembly. For example, the zipper assembly may be exposed through an access slot along the front panel and/or a top end of the enclosure. In this alternative design, the zipper assembly may include a frangible seal adjacent zipper interlocking elements. The frangible seal hermetically seals the zipper interlocking elements and the contents of the enclosure from the external environment. The user may permanently break the frangible seal to open the enclosure the first time, such that the user subsequently closes and opens the enclosure using the zipper interlocking elements (but not the frangible seal). Although less difficult and costly to manufacture than the enclosures with tearable tape strips, a drawback in this alternative design is that the open access to the zipper assembly may fail to conspicuously assure users that the enclosure is hermetically sealed and that no tampering with the contents has occurred. Furthermore, the open access to the zipper assembly may fail to block dirt, dust, and/or other debris from collecting on the zipper assembly above the frangible seal.

It may be desirable to provide a flexible, reclosable enclosure that differs from those that are currently available.

BRIEF DESCRIPTION

In one or more embodiments, a reclosable enclosure is provided that includes a body and a zipper assembly. The body has a front panel and a back panel secured to each other and forming a cavity therebetween to store contents. The body includes a flap that extends from a top end of the body. The zipper assembly is coupled to an interior surface of at least the front panel. The zipper assembly includes a first profile strip and a second profile strip that form a reclosable zipper to selectively close the cavity. The flap blocks access to the reclosable zipper and is sealed to at least one of the front panel or the second profile strip in an intact state of the flap. The flap defines one or more lines of weakness to permit irreparable separation of a sub-flap from a remainder of the flap to access the reclosable zipper.

Optionally, the front panel defines an access slot through a thickness of the front panel. The zipper assembly may be disposed interior of the front panel and accessible through the access slot. The flap in the intact state may cover the access slot, and the sub-flap may be lifted to uncover the access slot. Optionally, the flap is an integral extension of the back panel. Optionally, the zipper assembly includes a frangible seal member that seals the first profile strip to the second profile strip when the frangible seal is intact to hermetically seal the cavity.

Optionally, the first profile strip of the zipper assembly is mounted to the flap at a first permanent seal, and the second profile strip of the zipper assembly is mounted to the interior surface of the front panel at a second permanent seal. The sub-flap of the flap may extend from the first permanent seal towards a distal edge of the flap. The reclosable enclosure may include a frangible seal member that seals the flap to an exterior surface of the front panel in the intact state of the flap. The frangible seal member may be broken to lift the sub-flap and access the reclosable zipper. Alternatively, the reclosable enclosure may include a frangible seal that seals the flap to a flange of the second profile strip of the zipper assembly in the intact state of the flap. The frangible seal member may be broken to lift the sub-flap and access the reclosable zipper.

Optionally, the one or more lines of weakness are perforation lines. The flap may include a first side edge and a second side edge opposite the first side edge. The flap may be sealed to the front panel along both the first and second side edges. The one or more lines of weakness may include a first side line and a second side line that are between the first and second side edges. The first and second side lines may define the sub-flap therebetween. The sub-flap may be lifted to rupture the first and second side lines and access the reclosable zipper. Optionally, a distal edge of the flap defines a distal edge of the sub-flap. Optionally, the first and second side lines are parallel to each other.

Optionally, the flap extends from the top end to a distal edge of the flap, and the flap is sealed to the front panel along the distal edge. The one or more lines of weakness may include a lateral line disposed between the distal edge and the access slot along a height of the enclosure. Rupturing the lateral line may permit the sub-flap to be lifted to access the reclosable zipper. Optionally, the one or more lines of weakness include a first side line, a second side line spaced apart from the first side line, and a lateral line that extends from an end of the first side line to an end of the second side line. The first side line, second side line, and lateral line may define the sub-flap that can be lifted by rupturing the first side line, the second side line, and the lateral line to access the reclosable zipper.

Optionally, the front panel, the back panel, and the flap are composed of a mono-material film. The mono-material film may be polyethylene.

In one or more embodiments, a method of assembling a flexible reclosable enclosure is provided. The method includes forming one or more lines of weakness in a flap of one or more sheets of film material, and mounting a zipper assembly to an interior surface of at least a front panel of the one or more sheets. The zipper assembly includes a first profile strip and a second profile strip that form a reclosable zipper. The method includes folding and sealing the one or more sheets to form an enclosure that defines a cavity to hold contents. The folding and sealing causes the flap to block access to the reclosable zipper. The method includes sealing the flap to at least one of the front panel or the second profile strip of the zipper assembly to provide an intact state of the flap. The one or more lines of weakness may permit irreparable separation of a sub-flap from a remainder of the flap to access the reclosable zipper.

Optionally, the flap is an integral extension of a back panel of the one or more sheets of film material, and the folding and sealing comprises folding the flap around a top edge of the front panel. Optionally, the one or more sheets of film material are a single, continuous sheet such that the flap is integrally connected to the front panel. Optionally, the method includes cutting or punching an access slot through a front panel of the one or more sheets. The zipper assembly is accessible through the access slot, and the flap in the intact state covers the access slot.

In one or more embodiments, a reclosable enclosure is provided that includes a front panel, a back panel, and a zipper assembly. The front panel and the back panel are secured to each other and form a cavity therebetween to store contents. The front panel defines an access slot. The zipper assembly is coupled to at least an interior surface of the front panel and is accessible through the access slot. The zipper assembly includes a first profile strip and a second profile strip that form a reclosable zipper to selectively block passage between the access slot and the cavity. The back panel includes a flap that is folded around a top edge of the front panel and is sealed to an exterior surface of the front panel. The flap covers the access slot and defining one or more lines of weakness to permit irreparable separation of a sub-flap of the flap from the front panel to uncover the access slot. The front panel, the back panel, and the flap are composed of a mono-material film.

Optionally, the flap includes a first side edge and a second side edge opposite the first side edge. The flap may be sealed to the front panel along both the first and second side edges. The one or more lines of weakness may include a first side line and a second side line that are between the first and second side edges. The first and second side lines may define the sub-flap therebetween, and the sub-flap may be lifted to rupture the first and second side lines and uncover the access slot.

BRIEF DESCRIPTION OF THE DRAWINGS

The inventive subject matter will now be illustrated with reference to the following figures, in which.

DETAILED DESCRIPTION

Embodiments set forth herein include a flexible enclosure with an integrated flap that covers a zipper assembly of the flexible enclosure. The zipper assembly provides a reclosable opening to a cavity of the enclosure. The flap may function as a dust-cover to block debris from collecting on the zipper assembly. The flap may also function as a tamper-evident feature to provide assurance to users and potential users (e.g., customers) that the contents of the flexible enclosure have not been tampered with. For example, in one or more embodiments, the flap is sealed to an exterior surface of a front panel of the enclosure, and defines one or more lines of weakness. Each line of weakness is designed to tear along the line, which irreparably (e.g., permanently) separates at least a portion of the flap from the front panel to permit access to the zipper assembly. For example, when the one more lines of weakness are intact, the flap blocks access to the zipper assembly and the contents inside the enclosure. A user can view the intact unbroken line(s) of weakness as an indicator that the enclosure has not been previously opened.

In an embodiment, the flexible enclosure may lack a tearable tape strip that seals an access slot to the zipper assembly. The flexible enclosures described herein with the folded flaps may be less complex and costly to manufacture than known enclosures that include tearable tape strips. For example, at least some known enclosures with tearable tape strips are formed of laminate films that are laser scored to define the tearable tape strips. The flexible enclosures described herein may be manufactured without laser scoring and/or may allow for greater variability in materials. For example, in at least one embodiment, the body panels of the enclosure (which define the internal cavity that holds the contents) may be composed of a mono-material, meaning a single chemical compound, as opposed to a laminate of multiple different sheets or films pressed together in a stack. The mono-material may be a polymeric material. In a specific example, the panels of the enclosure may be composed entirely of polyethylene (PE).

In the following description and claims, relative or spatial terms such as "front," "back," "side," "top," "bottom," "lateral," "longitudinal," and the like are only used to distinguish the referenced elements or features with respect to one another according to the orientations depicted in the illustrated drawings, and make the description more readily understandable. The terms do not necessarily require particular positions, sizes, or orientations relative to the surrounding environment. Moreover, in the following description and claims, the terms "first," "second," and "third," etc. may be used as labels to distinguish similar objects (e.g., first and second sheets), and are not intended to impose numerical requirements on the associated objects.

Figure 1:
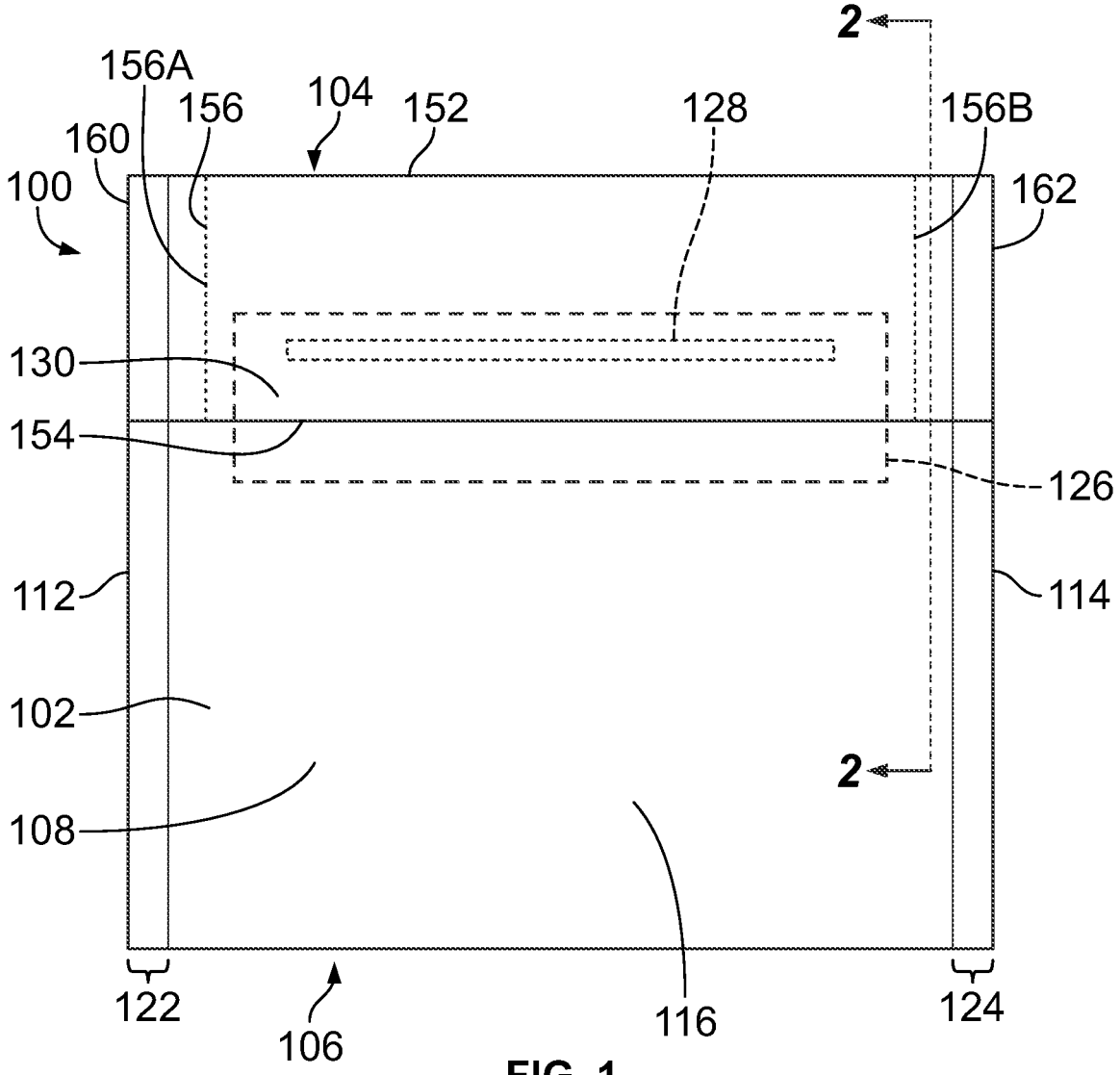
FIG. 1 illustrates a front plan view of a reclosable enclosure according to an embodiment of the present disclosure.
Figure 2:
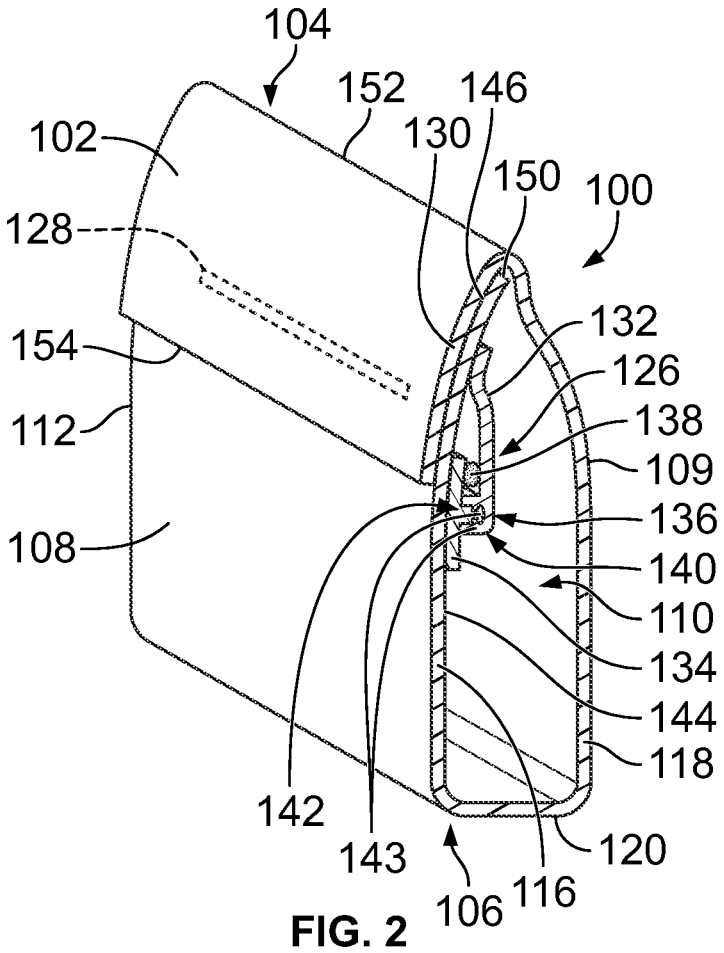
FIG. 2 is a perspective cross-sectional view of the enclosure of FIG. 1.

FIG. 1 illustrates a front plan view of a reclosable enclosure 100 according to an embodiment. FIG. 2 is a perspective cross-sectional view of the enclosure 100. The cross-section is taken along line 2-2 in FIG. 1. The enclosure 100 may be one of various types of containers, such as a pouch, package, bag, baggie, envelope, or the like. The enclosure 100 may be flexible. The enclosure 100 includes one or more body panels that form a cavity 110 to contain product contents. The contents may be dispensed or retrieved from the enclosure 100 once the enclosure 100 is opened. The contents may be solid, liquid, or quasi-solid (e.g., gel, foam, etc.). Some examples of the contents include food (e.g., fruit, vegetables, yogurt, coffee grounds, baby food, drinks, condiments, etc.), hygienic goods (e.g., lotion, toothpaste, shaving cream, shampoo, soap, etc.), household goods (e.g., cleaning supplies), and the like. The enclosure 100 may provide an airtight seal that protects the contents from the external ambient environment.

The enclosure 100 includes a body 102 that extends a height from a top end 104 of the body 102 to a bottom end 106 of the body 102 (opposite the top end 104). The body 102 extends a longitudinal depth from a front side 108 of the body 102 to a back side 109 of the body 102 (opposite the front side 108). The body 102 has a width that laterally extends from a first side edge 112 of the body 102 to a second side edge 114 (opposite the first side edge 112). The body 102 includes one or more body panels that are folded and/or connected to define the enclosure 100 shape and form the cavity 110.

The enclosure 100 may have any number of body panels. In the illustrated embodiment, the body 102 includes a first body panel 116 along the front side 108, a second body panel 118 along the back side 109, and a third body panel 120 along the bottom end 106. The third body panel 120 may provide a floor or bottom wall of the enclosure 100. The first and second body panels 116, 118 may extend from the third body panel 120. The first body panel 116 is referred to herein as a front panel 116, the second body panel 118 is referred to herein as a back panel 118, and the third panel 120 is referred to herein as a bottom panel 120 for clarity of description. The cavity 110 is defined between the panels 116, 118, 120. The contents of the enclosure 100 are held within the cavity 110. In an embodiment, the panels 116, 118, 120 may be fixedly attached to each other by securing respective edges of the panels together to seal the cavity 110 from the ambient environment. For example, the front panel 116 may be secured to the back panel 118 along the first side edge 112 and along the second side edge 114. The panels 116, 118 may be secured or attached to each other via adhesive bonding, crimping or other mechanical crushing, heating to thermally weld the panels, and/or the like. The panels 116, 118 may be secured in a way that hermetically seals the interface between the panels 116, 118. In an embodiment, the front panel 116 may be secured to the back panel 118 at the first and second side edges 112, 114 along the entire height of the enclosure 100. The areas along which the panels 116, 118 are attached to each other are first and second seal areas 122, 124 shown in FIG. 1. For example, the panels 116, 118 are not secured to each other between the seal areas 122, 124.

The body panels 116, 118, 120 may be thin sheets of film material. In one or more embodiments, the film material is a mono-material film the only includes a single compound. For example, all of the body panels may be sheets of a mono-material polymer film. The single compound in an embodiment is polyethylene. In an alternative embodiment, the single compound of the mono-material film may be polypropylene, polyester, or the like. Compositions referred to herein as mono-materials include one base material that constitutes the majority of the composition by mass and/or volume. For example, the base material may be polyethylene or polypropylene. The mono-material compositions may include additive materials (e.g., slip, anti-block, etc.) blended in with the base material. The mono-material compositions optionally may include a blend of materials that are variations of each other and cumulatively constitute the base material. For example, the base material may be a blend of low-density polyethylene (LDPE) with linear low-density polyethylene (LLDPE) and/or high-density polyethylene (HDPE). In an alternative embodiment, the film material of the body panels may be a laminate film that includes multiple layers (e.g., sheets or plies) pressed together to define the single laminate film. For example, a first set of one of more of the layers may be polyethylene, and a second set of the layers in the film may be polyester.

Optionally, all (or at least two) of the panels 116, 118, 120 of the body 102 may be formed from a continuous sheet of the film material. For example, a single sheet may be rolled, folded and formed to define the front panel 116, the bottom panel 120, and the back panel 118. The portions of the sheet that represent the front and back panels 116, 118 may be secured to each other at the side edges 112, 114, as described above, to form the cavity 110.

The body 102 of the enclosure 100 can have different shapes in other embodiments, including different numbers of body panels and/or arrangements of the panels. For example, the front and back panels 116, 118 may be connected to side walls at the first and second side edges 112, 114 of the enclosure 100. The side walls may extend the height of the enclosure. The side walls may form gussets that enable enlarging and reducing the depth of the cavity 110. In another example, the enclosure 100 may lack the bottom panel 120, and the front panel 116 may secure to the back panel 118 at the bottom end 106.

The enclosure 100 includes a zipper assembly 126 that provides a reclosable opening to the cavity 110. The zipper assembly 126 is represented by a phantom rectangle in FIG. 1 because the zipper assembly 126 is disposed behind the front side 108 (e.g., interior of the front panel 116). The body 102 of the enclosure 100 may include an access slot 128. The access slot 128 may be an opening that is defined by the front panel 116 and extends through a thickness of the front panel 116. The access slot 128 is open to the zipper assembly 126, such that the zipper assembly 126 is accessed through the access slot 128. The access slot 128 is shown in phantom in both FIGS. 1 and 2 because the access slot 128 is covered by a flap 130 of the enclosure 100.

With reference to FIG. 2, the zipper assembly 126 includes a first profile strip 132 and a second profile strip 134. The first and second profile strips 132, 134 include complementary, interlocking elements that form a reclosable zipper 136. The zipper 136 is an intermeshable closure member. For example, the first profile strip 132 includes a first set 140 of one or more locking elements 143, and the second profile strip 134 includes a second set 142 of one or more locking elements 143. When the strips 132, 134 are properly aligned and squeezed into contact with each other, the first set 140 intermeshes with the second set 142 to close the zipper 136. When the first profile strip 132 and the second profile strip 134 are pulled apart with sufficient force to overcome the retention force of the locking elements 143, the zipper 136 opens and defines an opening or passage that connects the access slot 128 to the cavity 110. For example, with the zipper 136 open, a user may be able to dispense, retrieve, and/or add contents to the cavity 110 through the access slot 128.

In the illustrated embodiment, the zipper assembly 126 is mounted interior of the front panel 116. For example, the first profile strip 132 and the second profile strip 134 may each be mounted to an interior surface 144 of the front panel 116. The profile strips 132, 134 are discrete and separately mounted to the front panel 116. For example, the first profile strip 132 may be secured to the front panel 116 above the access slot 128, and the second profile strip 134 secured to the front panel 16 below the access slot 128. Neither profile strip 132, 134 is secured to the back panel 118. In an alternative embodiment, one of the profile strips 132, 134 is secured to the front panel 116, and the other profile strip 132, 134 is secured to the back panel 118. Regardless of the mounting of the profile strips 132, 134 to the body 102, the zipper assembly 126 may be arranged such that the reclosable zipper 136 is between the access slot 128 and the cavity 110. The enclosure 100 may be designed such that the only way to access the cavity 110 through the access slot 128 is through the reclosable zipper 136. In the illustrated embodiment, the zipper 136 is in the closed state, so the access slot 128 is not open to the cavity 110. Although not shown in FIGS. 1 and 2, the lateral ends of the first and second profile strips 132, 134 may be fixedly secured to each other, such as by mechanical crimping/crushing, thermal welding, adhesive bonding, or the like, to define ends of the opening, reinforce the zipper assembly 126, and withstand excessive forces that pull the first and second profile strips 132, 134 away from each other.

In an embodiment, the zipper assembly 126 includes a frangible seal 138. The frangible seal 138 seals the first profile strip 132 to the second profile strip 134 when the frangible seal 138 is intact. In the intact state, the frangible seal 138 may hermetically seal the opening to the cavity 110, providing an air-tight barrier to protect the contents of the cavity 110. The frangible seal 138 is interior of the front panel 116 and (vertically) disposed between the access slot 128 and the reclosable zipper 136. The frangible seal 138 may be designed to rupture and break prior to initial opening of the reclosable zipper 136. Once ruptured/broken, the frangible seal 138 can no longer seal the two profile strips 132, 134 together. For example, the frangible seal 138 may not be resealable, such that the rupturing of the seal 138 permanently breaks the seal 138. In an embodiment, the frangible seal 138 may be an adhesive bead or strip, such as a pre-activated peel seal. In another embodiment, the seal 138 may be an airtight web of filaments. The enclosure 100 may be packaged and shipped with the reclosable zipper 136 in the closed position and the frangible seal 138 intact. The intact frangible seal 138 provides assurance to the user that the enclosure 100 has not been previously opened or tampered with. The zipper 136 may not provide such assurance because the zipper 136 is reclosable. In addition to tamper assurance, the frangible seal 138 may provide a level of hermeticity that the reclosable zipper 136 cannot provide. In an alternative embodiment, the zipper assembly 126 may lack the frangible seal 138. For example, one or more applications may not require a hermetically-sealed cavity 110 and/or tamper assurance incorporated into the zipper assembly 126.

The zipper assembly 126 and the access slot 128 may be elongated along the lateral width of the enclosure 100. The access slot 128 may at least partially align with the area of the zipper assembly 126. The flap 130 of the enclosure 100 extends from the top end 104 of the body 102 downward. At least a portion of the flap 130 may extend along and overlap an exterior surface 146 of the front panel 116. The flap 130 may cover the access slot 128 when the flap 130 is in an initial, intact state, also referred to herein as a lowered state. The flap 130 covers the access slot 128 to block the entry of dust, dirt, and/or other debris into the access slot 128. In an embodiment, the flap 130 also provides a conspicuous tamper-evident indicator/feature. For example, the flap 130 may be sealed to the exterior surface 146 of the front panel 116 to block access to the access slot 128. A stretched or torn flap 130 that exposes the access slot 128 may be a conspicuous indication of possible tampering, meaning that the enclosure 100 may have been opened post-manufacturing. The flap 130 may be a discrete component from the zipper assembly 126. In an embodiment, even if the flap 130 has been compromised, if the frangible seal 138 of the zipper assembly 126 is still intact, then the cavity 110 is sealed and the enclosure 100 has not been opened. If the flap 130 is intact (e.g., not stretched or torn) and blocks access to the zipper assembly 126, then that is a conspicuous indication to the user that the enclosure 100 is tamper-free. The flap 130 may be more conspicuous than the frangible seal 138 of the zipper assembly 126, which may be behind the front panel 116.

In the illustrated embodiment, the flap 130 is an integrated extension of the back panel 118. The flap 130 is a portion of the back panel 118 that is folded over a top edge 150 of the front panel 116. The flap 130 extends from a fold line 152 to a distal edge 154 of the flap 130. The fold line 152 may be at the top end 104 of the enclosure 100. The distal edge 154 may be between the access slot 128 and the bottom end 106 along a height of the enclosure 100. In an alternative embodiment, the flap 130 may be an integrated extension of the front panel 116 that is folded back upon itself at the fold line 152.

The flap 130 may be sealed to the exterior surface 146 of the front panel 116 at one or more locations. The sealing of the flap 130 to the front panel 116 ensures that the flap 130 covers the access slot 128 without becoming displaced, and provides the tamper-evident indicator. In one or more embodiments, the flap 130 does not hermetically seal the access slot 128 (or the cavity 110). For example, the flap 130 optionally is not sealed to the front panel 116 along an entire perimeter of the flap 130.

In one or more embodiments, the flap 130 defines one or more lines of weakness 156 that permit irreparable separation of at least a portion of the flap 130 from a remainder of the flap 130 to uncover the zipper assembly 126 and permit access to the reclosable zipper 136. The one or more lines of weakness 156 may be perforation lines in which the flap 130 is intermittently penetrated to define a line of perforations (e.g., small holes or indents) in the flap 130. Optionally, one of more of the lines of weakness 156 may be score lines defined by a laser tool, or the like. The lines of weakness 156 define tearable seams in the flap 130. For example, lifting up on the flap 130 may cause the flap 130 to tear along the lines of weakness 156, which defines a sub-flap 158 (shown in FIG. 3) of the flap 130. When the sub-flap 158 is separated from the remainder of the flap 130, the flap 130 may transition to an open state. For example, when the sub-flap 158 is lifted, the access slot 128 is exposed to permit access to the reclosable zipper 136. The flap 130 may not block access to the zipper assembly 126 when the sub-flap 158 is lifted.

In the illustrated embodiment, the flap 130 includes a first side edge 160 and a second side edge 162 opposite the first side edge 160. The flap 130 is sealed to the front panel 116 along both the first and second side edges 160, 162. The first and second side edges 160, 162 of the flap 130 may be collinear and coextensive with the seal areas 122, 124 along the first and second side edges 112, 114 of the body 102. The lines of weakness 156 include a first side line 156A and a second side line 156B that are between the first and second side edges 160, 162. In the illustrated embodiment, each of the first and second side lines 156A, 156B extends the length of the flap 130 from the fold line 152 to the distal edge 154. The side lines 156A, 156B may be parallel to each other. Optionally, the side lines 156A, 156B are linear.

Figure 3:
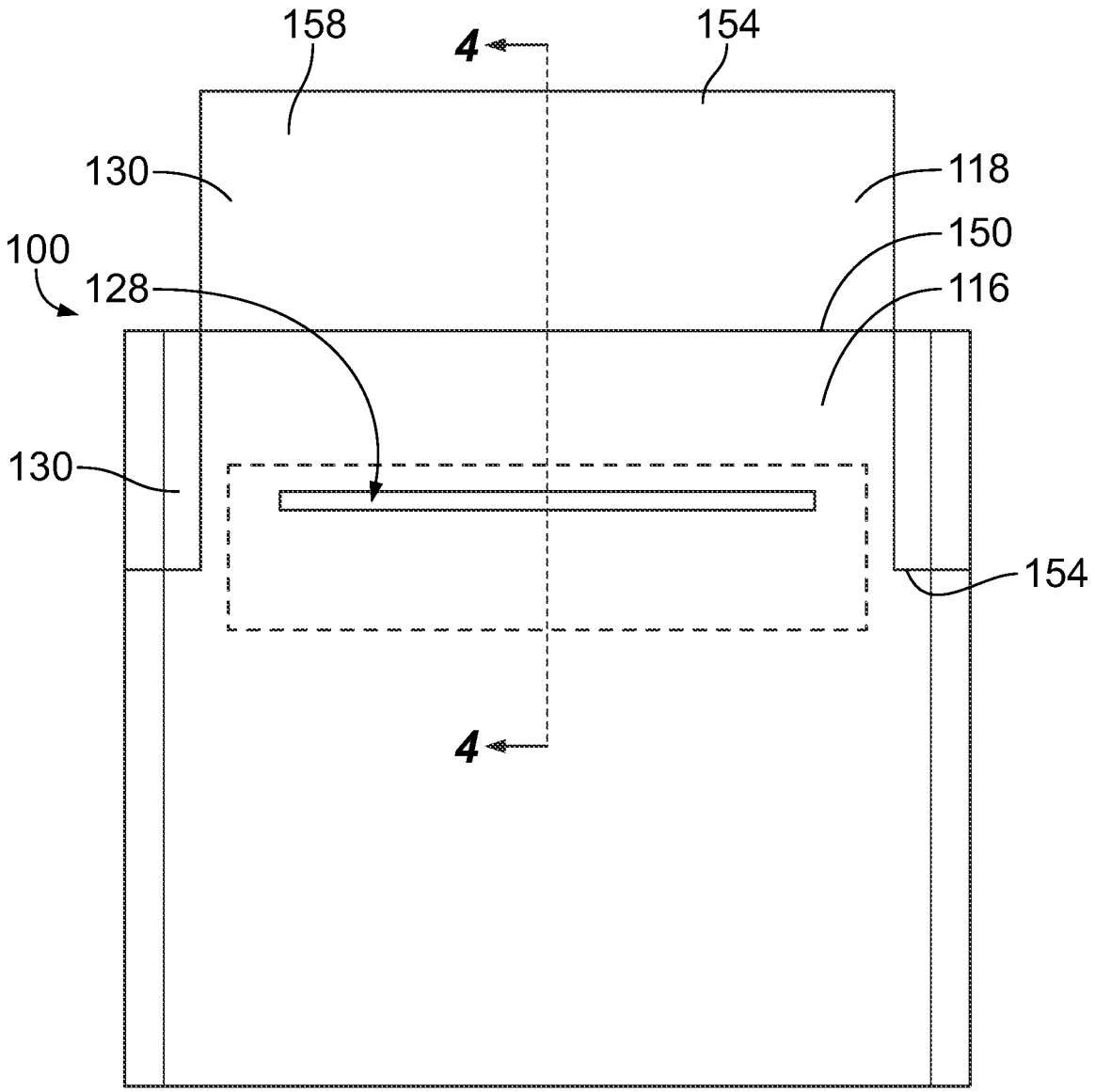
FIG. 3 is a front plan view of the enclosure in FIG. 1, showing a sub-flap of a flap in a lifted position.

The first and second side lines 156A, 156B define a sub-flap 158 therebetween, which is shown in FIG. 3. FIG. 3 is a front plan view of the enclosure 100 in FIG. 1, showing the sub-flap 158 of the flap 130 in a lifted position. In the illustrated embodiment, the distal edge 154 of the flap defines a distal edge of the sub-flap 158. The flap 130 is designed to be lifted by pulling up on the distal edge 154 between the side lines 156A, 156B (e.g., by lifting the sub-flap 158). The lifting may rupture or tear the flap 130 along the first and second side lines 156A, 156B of weakness. The sub-flap 158 is then freely lifted to uncover the access slot 128 and permit access to the zipper assembly 126. The sub-flap 158 portion of the flap 130 may not be sealed to the front panel 116, so once the sub-flap 158 is separated along the lines of weakness 156, the sub-flap 158 is easily lifted out of the way to access the slot 128. One or more of the portions of the flap 130 outside of the sub-flap 158 may remain sealed to the front panel 116, as shown in FIG. 3.

Figure 4:
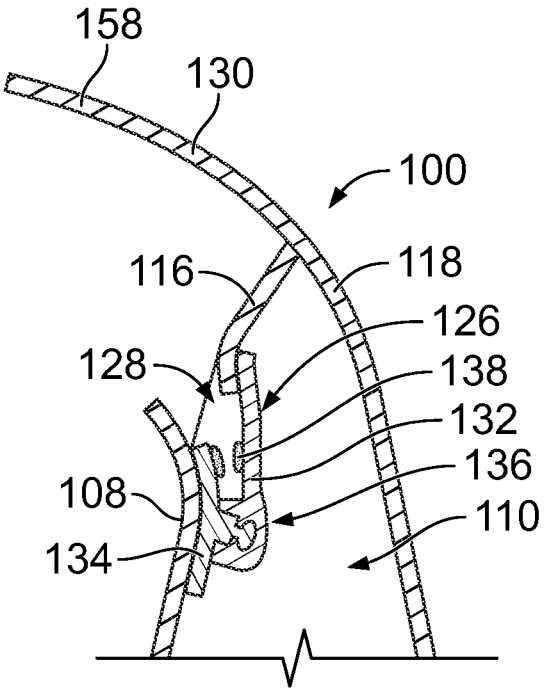
FIG. 4 is a cross-sectional view of a portion of the enclosure of FIG. 1 showing the sub-flap of the flap in the lifted position.

FIG. 4 is a cross-sectional view of a portion of the enclosure 100 showing the sub-flap 158 of the flap 130 in the lifted position. The cross-section of FIG. 4 is taken along line 4-4 in FIG. 3. In FIG. 4, with the sub-flap 158 lifted out of the way, the access slot 128 is uncovered (e.g., exposed, revealed, accessible, etc.) along the front side 108 of the enclosure 100. In the illustrated embodiment, the frangible seal 138 of the zipper assembly 126 is broken or ruptured (e.g., open), and the reclosable zipper 136 is closed. In this state, the zipper 136 can be opened to provide access to the cavity 110 through the access slot 128 for dispensing, adding, and/or retrieving contents. To reclose the enclosure 100, the profile strips 132, 134 can be pressed together to close the zipper 136, and the sub-flap 158 can be lowered or released to cover the access slot 128 again. The sub-flap 158 may continue to function as a debris cover.

Figure 5:
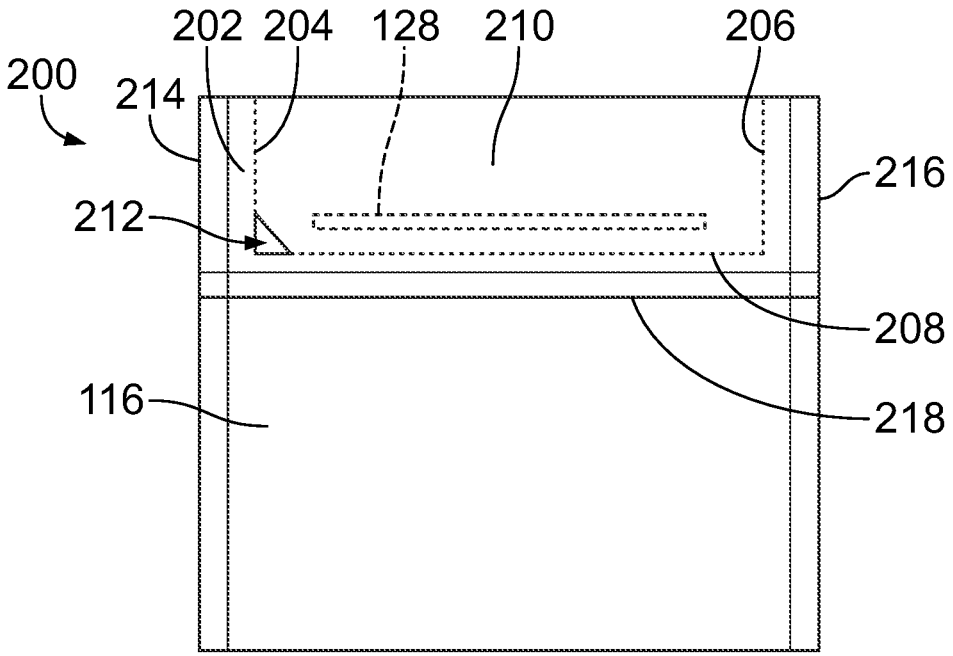
FIG. 5 is a front plan view of a flexible reclosable enclosure according to a second embodiment.

FIG. 5 is a front plan view of a flexible reclosable enclosure 200 according to a second embodiment. The enclosure 200 may be the same or similar to the enclosure 100 as described in FIGS. 1 through 4 except for the flap. The enclosure 200 includes a flap 202 that covers the access slot 128 when the flap 202 is intact and sealed to the front panel 116. The flap 202 includes one or more lines of weakness. The lines of weakness include a first side line 204, a second side line 206 spaced apart from the first side line 204, and a lateral line 208 that extends from an end of the first side line 204 to an end of the second side line 206. The first side line 204, second side line 206, and lateral line 208 define a sub-flap 210 that can be lifted by rupturing the lines of weakness 204, 206, 208 to uncover the access slot 128. In an embodiment, the side lines 204, 206 are linear and parallel, and the lateral line 208 is perpendicular to the side lines 204, 206, such that the sub-flap 210 is rectangular. Optionally, the flap 202 may include a cut-out corner 212 which provides a location at which a user can grasp the sub-flap 210 to initiate breaking of the lines of weakness. Optionally, the flap 202 is sealed to the front panel 116 along both first and second lateral edges 214, 216 of the flap 202 and along a distal edge 218 of the flap 202.

Figure 6:
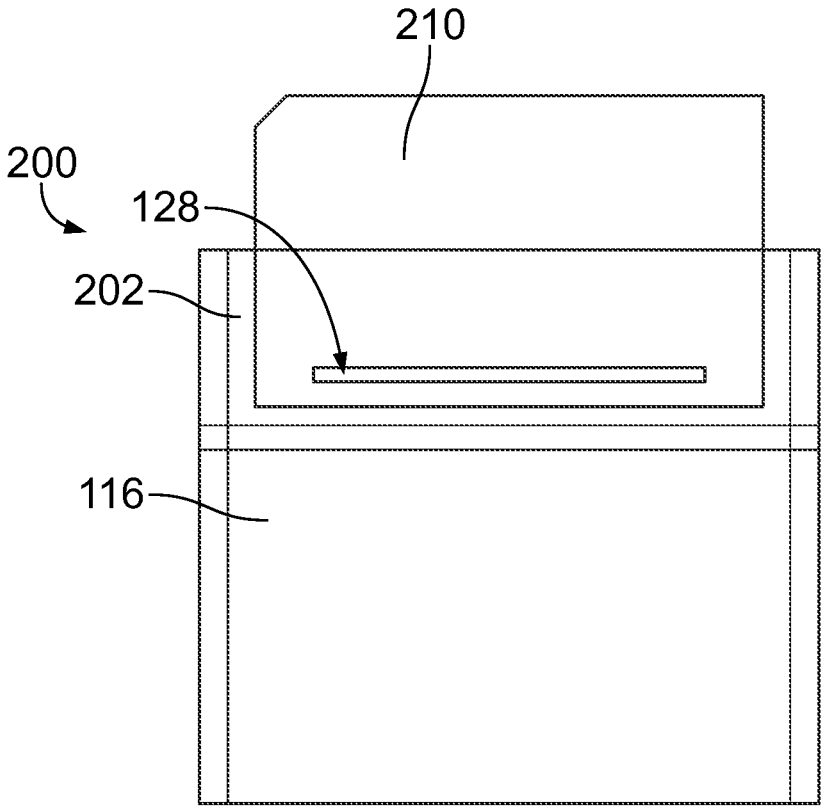
FIG. 6 is a front plan view of the enclosure in FIG. 5, showing a sub-flap of a flap in a lifted position.

FIG. 6 is a front plan view of the enclosure 200 in FIG. 5, showing the sub-flap 210 of the flap 202 in a lifted position. The sub-flap 210 is lifted out of the way to uncover the access slot 128. The sealed portions of the flap 202 outside of the sub-flap 210 remain secured to the front panel 116.

Figure 7:
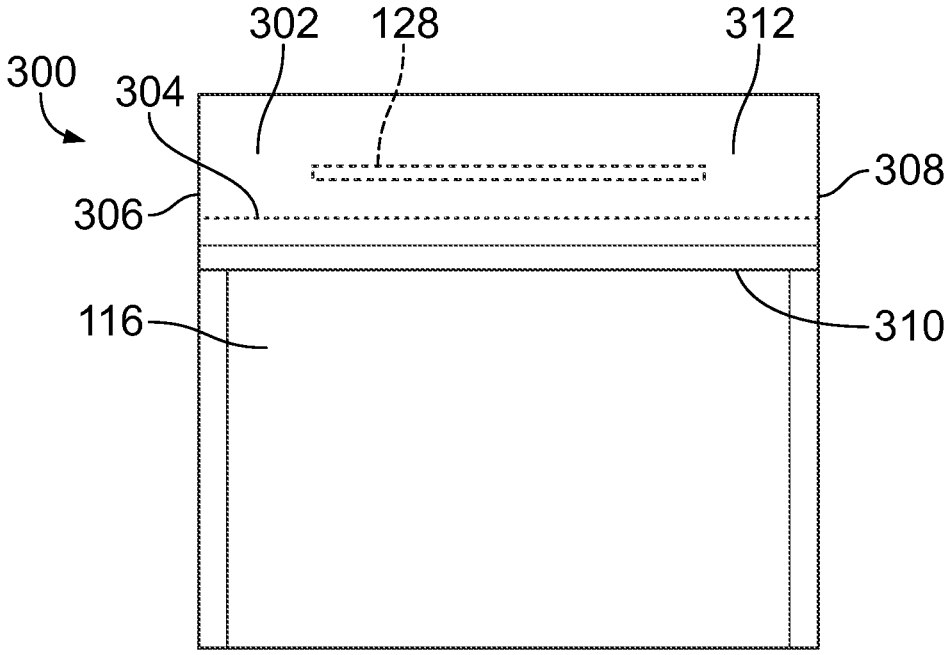
FIG. 7 is a front plan view of a flexible reclosable enclosure according to a third embodiment.

FIG. 7 is a front plan view of a flexible reclosable enclosure 300 according to a third embodiment. The enclosure 300 may be the same or similar to the enclosure 100 as described in FIGS. 1 through 4 except for the flap. The enclosure 300 includes a flap 302 that covers the access slot 128 when the flap 302 is intact and sealed to the front panel 116. The flap 302 includes a single line of weakness 304 that laterally extends across a width of the flap 302, from a first side edge 306 of the flap 302 to a second side edge 308 of the flap 302. The flap 302 may be sealed to the front panel 116 along or proximate to the distal edge 310 of the flap 302. For example, the flap 302 is secured to the front panel 116 below the line of weakness 304.

To open the enclosure 300, the user may grip one of the side edges 306, 308 of the flap 302 above the line of weakness 304 and pull to tear the flap 302 at the line of weakness 304. Once fully broken, a sub-flap 312 of the flap 302 can be lifted to uncover the access slot 128, similar to FIGS. 3 and 6.

Figure 8:
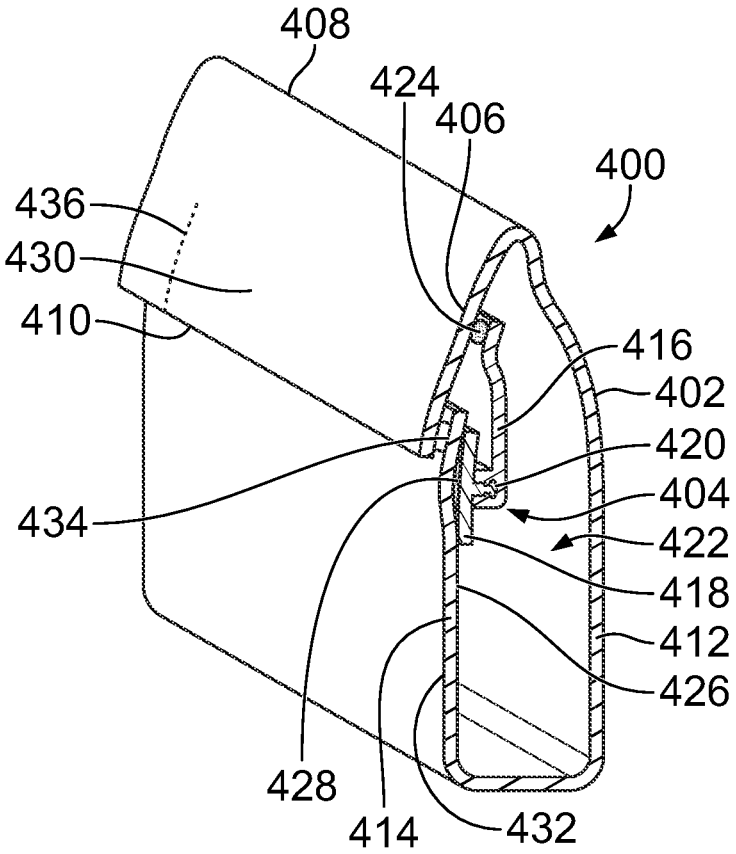
FIG. 8 is a perspective cross-sectional view of an enclosure according to another embodiment.

FIG. 8 is a perspective cross-sectional view of an enclosure 400 according to another embodiment. The enclosure 400 has a body 402 that may be similar to the body 102 shown in FIG. 1. The cross-section in FIG. 8 may be taken along a line that is similar to the line 2-2 in FIG. 1. The enclosure 400 has a zipper assembly 404 that may be the same or similar to the zipper assembly 126. The enclosure 400 may deviate from the enclosure 100 by the way that the zipper assembly 404 is mounted to the body 402.

The body 402 includes a flap 406 that extends from a top end 408 of the body 402 downward to a distal edge 410 of the flap 406. The flap 406 is an extension of a back panel 412 in the illustrated embodiment, but may be an extension of a front panel 414 or a discrete panel in alternative embodiments. The zipper assembly 404 includes a first profile strip 416 and a second profile strip 418 that include complementary, interlocking elements to form a reclosable zipper 420. The reclosable zipper 420 selectively opens and closes to open and close a cavity 422 of the enclosure 400. In the illustrated embodiment, the first profile strip 416 is mounted to the flap 406 at a first permanent seal 424, and the second profile strip 418 is mounted to an interior surface 426 of the front panel 414 at a second permanent seal 428. The permanent seals 424, 428 may fixedly secure the corresponding components to each other, such as by mechanical crimping/crushing, thermal welding, adhesive bonding, or the like. The permanent seals 424, 428 may laterally extend along at least a portion of the width of the body 402, such as a majority of the width and optionally the entire lateral width of the zipper assembly 404.

The first permanent seal 424 may be vertically disposed below the top end 408, such that a portion of the flap 406 extends from the top end 408 to the first permanent seal 424. A sub-flap 430 of the flap 406 extends from the first permanent seal 424 towards the distal edge 410. The sub-flap 430 lifts up to uncover the zipper assembly 420 and provide access to the cavity 422. A distal portion of the flap 406 at (or at least proximate to) the distal edge 410 overlaps a portion of the front panel 414 and is sealed to an exterior surface 432 of the front panel 414. In an embodiment, a frangible seal member 434 seals the overlapping portions of the flap 406 and the front panel 414 to each other. The frangible seal member 434 is initially intact, and is broken by lifting up the flap 406 along the distal edge 410. The frangible seal member 434 may be similar to the frangible seal 138 of the zipper assembly 126 in FIG. 2. Once broken, the frangible seal member 434 is irreversibly severed.

In the illustrated embodiment, the sub-flap 430 extends to the distal edge 410. The frangible seal member 434 seals the sub-flap 430 to the front panel 414 while the flap 406 is in the intact state. In the intact state, the flap 406 blocks access to the zipper assembly 404, providing a dust cover and tamper assurance. The flap 406 may define one or more lines of weakness 436 that define edges of the sub-flap 430. In the illustrated embodiment, the flap 406 may include two side lines of weakness 436, although only one is visible in the cross-section of FIG. 8. In an embodiment, a user can lift up the flap 406 at the distal edge 410 (in the location of the sub-flap 430) to break the frangible seal member 434 and sever the flap 406 along the lines of weakness 436. The lifting irreparably separates the sub-flap 430 from the flap 406. At this severed state of the flap 406, the sub-flap 430 is easily lifted to uncover the zipper assembly 404 for accessing the cavity 422.

Figure 9:
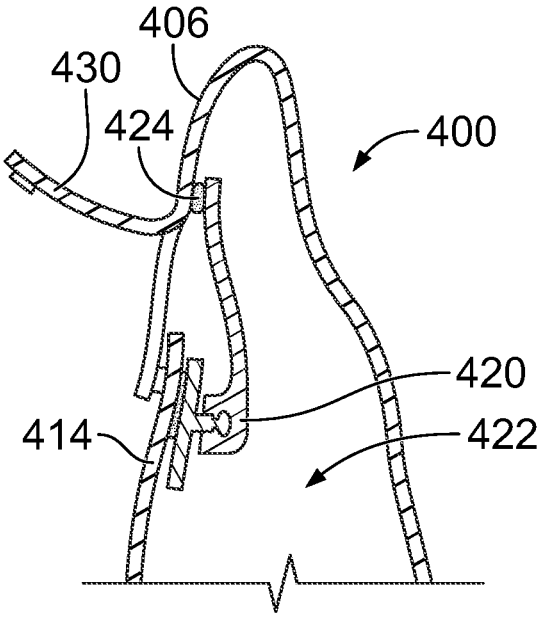
FIG. 9 is a cross-sectional view of a portion of the enclosure of FIG. 8 showing a sub-flap lifted away from a front panel.

FIG. 9 is a cross-sectional view of a portion of the enclosure 400 of FIG. 8 showing the sub-flap 430 of the flap 406 lifted away from the front panel 414. In the lifted position, entry to the cavity 422 is gained once the reclosable zipper 420 is opened. One benefit of the embodiment shown in FIGS. 8 and 9 is that no access slot needs to be formed through the front panel 414. A natural slot is formed between the top end of the front panel 414 and the portion of the flap 406 secured at the first permanent seal 424.

In an alternative embodiment, the flap 406 may include the one or more lines of weakness 436 or the frangible seal member 434, but not both. For example, the flap 406 may be permanently sealed to the front panel at edges of the flap 406, and the sub-flap 430 may be spaced apart from the edges of the flap 406. In an example, the sub-flap 430 may not extend fully to the distal edge 410, similar to the embodiment shown in FIGS. 5 through 7.

Figure 10:
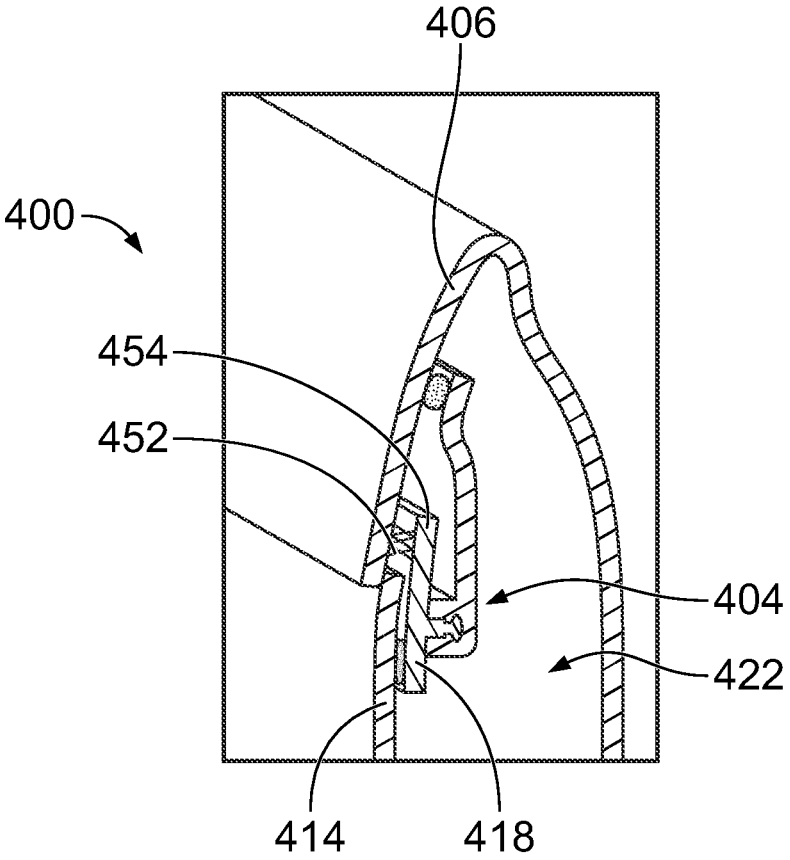
FIG. 10 is a perspective cross-sectional view of an enclosure according to another embodiment.

FIG. 10 is a perspective cross-sectional view of an enclosure 450 according to another embodiment. The enclosure 450 is a variation of the enclosure 400 shown in FIGS. 8 and 9. In FIG. 10, the flap 406 of the enclosure 450 is secured via a frangible seal member 452 to the second (e.g., lower) profile strip 418. The frangible seal member 452 may be the same as or similar in construction as the frangible seal member 434 in FIG. 8 and/or the frangible seal 138 in FIG. 2. For example, the frangible seal member 452 may be a one-time peelable seal, a severable web of filaments, or the like. The frangible seal member 452 seals the flap 406 to the profile strip 418 of the zipper assembly 404 when the frangible seal member 452 is intact, to cover the zipper assembly 404 which provides access to the cavity 422 of the enclosure 450. The profile strip 418 is secured to the front panel 414. Unlike the embodiment in FIGS. 8 and 9, the frangible seal member 452 is disposed on the profile strip 418, rather than the front panel 414. More specifically, the frangible seal member 452 is affixed to a flange 454 of the profile strip 418 that projects beyond (e.g., above) a top edge of the front panel 414. The frangible seal member 452 may have the same functions as the frangible seal member 434. Optionally, a distal portion of the flap 406 may overlap the front panel 414. Alternatively, the flap 406 may not overlap any portion of the front panel 414.

Figure 11:
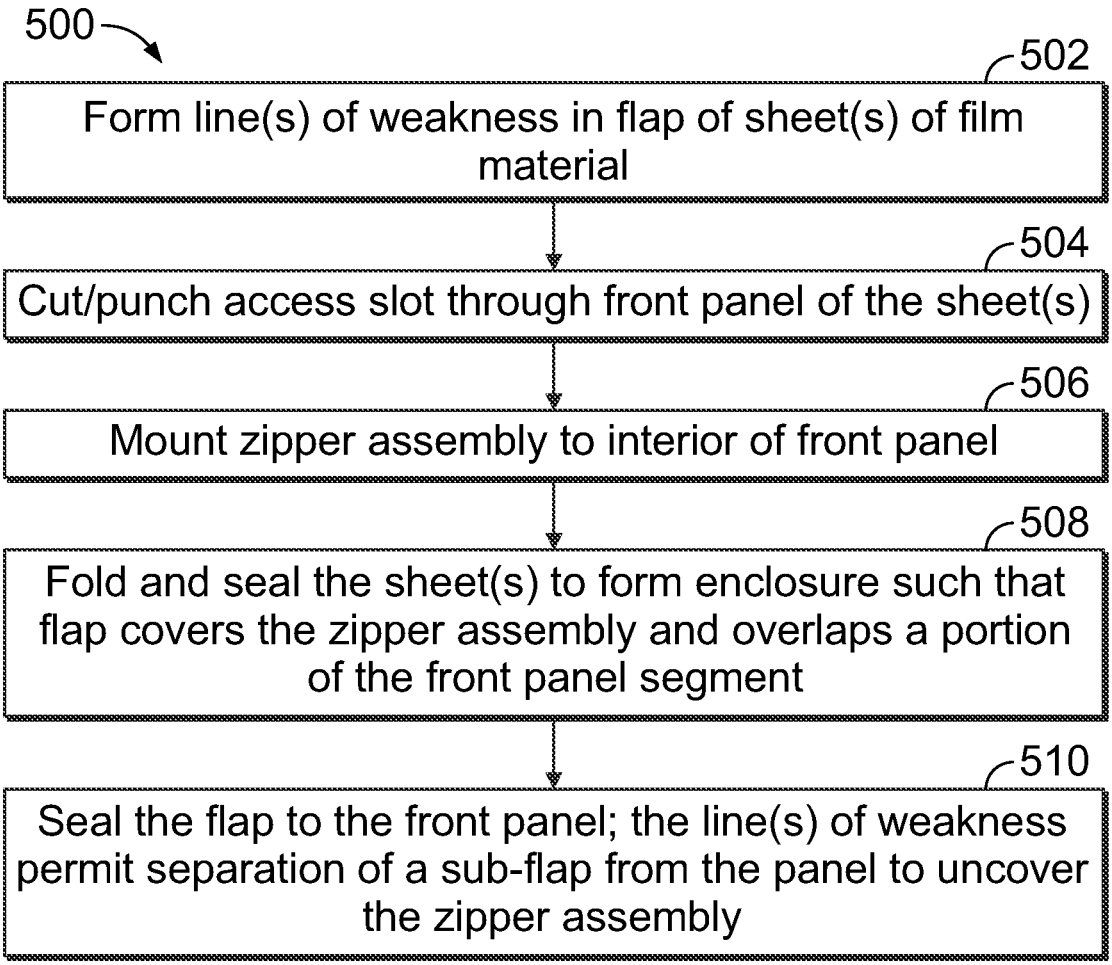
FIG. 11 is a flow chart of a method of forming a flexible reclosable enclosure according to an embodiment.

FIG. 11 is a flow chart 500 of a method of forming a flexible reclosable enclosure according to an embodiment. The method may represent a manufacturing process that is performed using one or more tools, robots, equipment, and/or the like. The method is not limited to the order of the following steps unless explicitly stated or logically mandated. The method optionally may include more steps than shown, fewer steps than shown, and/or different steps than shown in FIG. 11. In an embodiment, the method is performed to form one or more of the enclosures 100, 200, 300, 400 described herein.

At step 502, one or more lines of weakness are formed in a flap of one or more sheets of film material. Optionally, at step 504, an access slot is cut or punched through a front panel of the one or more sheets. At step 506, a zipper assembly is mounted to an interior surface of at least the front panel. At step 508, the one or more sheets of film material are folded and sealed to form an enclosure that defines a cavity. The one or more sheets are folded and sealed such that the flap covers the zipper assembly and overlaps a portion of the front panel. At step 510, the flap is sealed to the front panel to provide an intact state of the flap. In the intact state, the flap prevents access to the zipper assembly. In an embodiment in which the front panel defines an access slot, the flap covers the access slot in the intact state. The one or more lines of weakness may permit irreparable separation of a sub-flap of the flap from the front panel to uncover the zipper assembly and access the cavity. The sub-flap may selectively uncover the access slot along the front panel.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the inventive subject matter without departing from its scope. While the dimensions and types of materials described herein are intended to define the parameters of the inventive subject matter, they are by no means limiting and are example embodiments. Many other embodiments will be apparent to one of ordinary skill in the art upon reviewing the above description. The scope of the inventive subject matter should, therefore, be determined with reference to the appended claims, along with the full scope of equivalents to which such claims are entitled. In the appended claims, the terms "including" and "in which" are used as the plain-English equivalents of the respective terms "comprising" and "wherein." Further, the limitations of the following claims are not written in means-plus-function format and are not intended to be interpreted based on 35 U.S.C. § 112(f), unless and until such claim limitations expressly use the phrase "means for" followed by a statement of function void of further structure.

This written description uses examples to disclose several embodiments of the inventive subject matter and also to enable one of ordinary skill in the art to practice the embodiments of inventive subject matter, including making and using any devices or systems and performing any incorporated methods. The patentable scope of the inventive subject matter is defined by the claims, and may include other examples that occur to one of ordinary skill in the art. Such other examples are intended to be within the scope of the claims if they have structural elements that do not differ from the literal language of the claims, or if they include equivalent structural elements with insubstantial differences from the literal languages of the claims.

As used herein, an element or step recited in the singular and proceeded with the word "a" or "an" should be understood as not excluding plural of said elements or steps, unless such exclusion is explicitly stated. Furthermore, references to "one embodiment" of the present inventive subject matter are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property.

What is claimed is:

1. A reclosable enclosure comprising:

a body including a front panel and a back panel secured to each other and forming a cavity therebetween to store contents, the body including a flap that extends from a fold at a top end of the body to a distal edge of the flap and overlaps a portion of the front panel; and a zipper assembly coupled to an interior surface of at least the front panel, the zipper assembly comprising a first profile strip and a second profile strip that form a reclosable zipper to selectively close the cavity, wherein the first profile strip is secured to the flap at a first permanent seal that is spaced apart from the top end of the body, wherein a distal segment of the flap extending from the first permanent seal to the distal edge is sealed to at least one of an exterior surface of the front panel or the second profile strip of the zipper assembly, the distal segment of the flap defining one or more lines of weakness to permit irreparable separation of a sub-flap from a remainder of the distal segment, wherein the sub-flap blocks access to the reclosable zipper in an intact state and permits access to the reclosable zipper when separated from the remainder of the distal segment.

2. The reclosable enclosure of claim 1, wherein the front panel defines an access slot through a thickness of the front panel, the zipper assembly disposed interior of the front panel and accessible through the access slot, wherein the sub-flap in the intact state covers the access slot and the sub-flap is configured to be lifted to uncover the access slot.

3. The reclosable enclosure of claim 1, wherein the flap is an integral extension of the back panel.

4. The reclosable enclosure of claim 1, wherein the zipper assembly includes a frangible seal member that seals the first profile strip to the second profile strip when the frangible seal is intact to hermetically seal the cavity.

5. The reclosable enclosure of claim 1, wherein the second profile strip of the zipper assembly is mounted to the interior surface of the front panel at a second permanent seal.

6. The reclosable enclosure of claim 5, further comprising a frangible seal member that seals the sub-flap to an exterior surface of the front panel in the intact state, the frangible seal member configured to be broken to lift the sub-flap and access the reclosable zipper.

7. The reclosable enclosure of claim 5, further comprising a frangible seal that seals the sub-flap to a flange of the second profile strip of the zipper assembly in the intact state, the frangible seal member configured to be broken to lift the sub-flap and access the reclosable zipper.

8. The reclosable enclosure of claim 1, wherein the one or more lines of weakness are perforation lines.

9. The reclosable enclosure of claim 1, wherein the flap includes a first side edge and a second side edge opposite the first side edge, the flap sealed to the front panel along both the first and second side edges, the one or more lines of weakness include a first side line and a second side line that are between the first and second side edges, the first and second side lines defining the sub-flap therebetween, the sub-flap configured to be lifted to rupture the first and second side lines and access the reclosable zipper.

10. The reclosable enclosure of claim 9, wherein the distal edge of the flap defines a distal edge of the sub-flap.

11. The reclosable enclosure of claim 9, wherein the first and second side lines are parallel to each other.

12. The reclosable enclosure of claim 1, wherein the flap is sealed to the front panel along the distal edge of the flap below an access opening to the reclosable zipper, wherein the one or more lines of weakness include a lateral line disposed between the distal edge of the flap and the access slot opening along a height of the enclosure, wherein rupturing the lateral line permits the sub-flap to be lifted to expose the access opening to the reclosable zipper.

13. The reclosable enclosure of claim 1, wherein the one or more lines of weakness include a first side line, a second side line spaced apart from the first side line, and a lateral line that extends from an end of the first side line to an end of the second side line, wherein the first side line, second side line, and lateral line define the sub-flap that can be lifted by rupturing the first side line, the second side line, and the lateral line to access the reclosable zipper.

14. The reclosable enclosure of claim 1, wherein the front panel, the back panel, and the flap are composed of a mono-material film.

15. A method comprising:

forming one or more lines of weakness in a flap of one or more sheets of film material;

mounting a zipper assembly to the one or more sheets, the zipper assembly including a first profile strip and a second profile strip that form a reclosable zipper, the first profile strip secured to an interior surface of the flap at a first permanent seal;

folding and sealing the one or more sheets to form an enclosure that includes a front panel and a back panel and defines a cavity therebetween to hold contents, wherein the folding and sealing causes the flap to extend from a fold at a top end of the enclosure to a distal edge of the flap and overlap a portion of the front panel, wherein the reclosable zipper selectively closes the cavity; and sealing a distal segment of the flap, which extends from the first permanent seal to the distal edge, to at least one of an exterior surface of the front panel or the second profile strip of the zipper assembly, wherein the one or more lines of weakness are located along the distal segment and permit irreparable separation of a sub-flap from a remainder of the distal segment, wherein the sub-flap blocks access to the reclosable zipper in an intact state and permits access to the reclosable zipper when separated from the remainder of the distal segment.

16. The method of claim 15, wherein the flap is an integral extension of a back panel of the one or more sheets of film material, and the folding and sealing comprises folding the flap around a top edge of the front panel.

17. The method of claim 15, wherein the one or more sheets of film material are a single, continuous sheet such that the flap is integrally connected to the front panel and the back panel.

18. The method of claim 15, further comprising cutting or punching an access slot through the front panel of the one or more sheets, wherein the zipper assembly is accessible through the access slot and the sub-flap in the intact state covers the access slot.

19. A reclosable enclosure comprising:

a front panel and a back panel secured to each other and forming a cavity therebetween to store contents, wherein the back panel includes a flap that is folded around a top edge of the front panel and overlaps a portion of the front panel, the flap extending from a fold at the top edge of the front panel to a distal edge of the flap; and a zipper assembly coupled to an interior surface of the front panel, the zipper assembly comprising a first profile strip and a second profile strip that form a reclosable zipper to selectively close the cavity, wherein the first profile strip is secured to the flap and the front panel at a first permanent seal that is spaced apart from the fold, wherein a distal segment of the flap extending from the first permanent seal to the distal edge is sealed to at least one of an exterior surface of the front panel or the second profile strip, the distal segment of the flap defining one or more lines of weakness to permit irreparable separation of a sub-flap from a remainder of the distal segment, wherein the sub-flap blocks access to the reclosable zipper in an intact stage and permits access to the reclosable zipper when separated from the remainder of the distal segment.

20. The reclosable enclosure of claim 19, wherein the flap includes a first side edge and a second side edge opposite the first side edge, the flap sealed to the front panel along both the first and second side edges, the one or more lines of weakness include a first side line and a second side line that are between the first and second side edges, the first and second side lines defining the sub-flap therebetween, the sub-flap configured to be lifted to rupture the first and second side lines and access the reclosable zipper.

* * * * *